US005605445A

United States Patent [19]

Trimborn

[11] Patent Number: 5,605,445

[45] Date of Patent: Feb. 25, 1997

[54] LIQUID RING MACHINE HAVING A RELIEF PASSAGE FOR EXCESS LIQUID

[75] Inventor: Peter Trimborn, Feucht/Bundesrepublik, Germany

[73] Assignee: Siemens Aktiengesellschaft, Munich, Germany

[21] Appl. No.: 491,985

[22] PCT Filed: Jan. 11, 1994

[86] PCT No.: PCT/DE94/00021

§ 371 Date: Jul. 21, 1995

§ 102(e) Date: Jul. 21, 1995

[87] PCT Pub. No.: WO94/17309

PCT Pub. Date: Aug. 4, 1994

[30] Foreign Application Priority Data

Jan. 25, 1993 [DE] Germany ..... 43 01 907.2

[51] Int. Cl.[6] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,904,321 | 4/1933 | Nash | 417/68 |
| 3,289,918 | 12/1966 | Adams | 417/68 |
| 4,545,730 | 10/1985 | Lubke | 417/68 |

FOREIGN PATENT DOCUMENTS

| | | | |
|---|---|---|---|
| 0675378 | 5/1939 | Germany . | |
| 1503586 | 4/1970 | Germany . | |
| 3124867 | 11/1983 | Germany | 417/68 |
| 3617344 | 11/1988 | Germany . | |
| 1509661 | 5/1978 | United Kingdom . | |

*Primary Examiner*—Timothy Thorpe
*Assistant Examiner*—Roland G. McAndrews, Jr.
*Attorney, Agent, or Firm*—Kenyon & Kenyon

[57] ABSTRACT

When liquids are conveyed together in the liquid ring of a liquid ring machine, an increased power requirement and a deterioration of the running characteristics of the rotor result. A liquid ring machine for selectively conveying several liquids has a housing which eccentrically surrounds a rotor and whose end face is closed by lateral shields for the rotor shaft. At least one controlling body is provided with a suction slot and a delivery slot associated with the rotor, and in addition to the delivery slot, has a relief passage located in the delivery area. In order to obtain a liquid ring having an approximately constant thickness, the relief passage is directly connected to the working liquid supply line of the liquid ring machine so that excess liquid flowing out through the relief passage is added directly to the working liquid. The relief passage may also be connected with a closed feed channel which opens outside the machine housing.

7 Claims, 6 Drawing Sheets

LIQUID RING MACHINE HAVING A RELIEF PASSAGE FOR EXCESS LIQUID

This is a 371 of international application PCT/DE94/00021, filed Jan. 11, 1994, now international publication WO 94/17309.

BACKGROUND OF THE INVENTION

The present invention relates to a liquid ring machine for selectively conveying several liquids. A machine housing eccentrically surrounds a rotor, which is closed off by means of lateral shields for the rotor shaft on end faces. The liquid ring machine includes a pressure slot assigned to the rotor and at least one control body provided with a suction slot. The at least one control body has at least one relief passage located in the pressure region of the liquid ring machine.

A typical liquid ring machine is disclosed in German Patent Document No. DE-C-31 24 867. This type of machine transmits energy to the medium to be conveyed, by the rotor, via a liquid ring formed from working liquid. Since the working liquid is directly in contact with the medium to be conveyed, as an energy carrier and as a sealing element, vapors are condensed, liquid and dirt particles are also conveyed, hot gases are cooled and compression heat is absorbed by the working liquid. If liquids are conveyed together in the liquid ring, an increased power requirement and a deterioration of the running properties of the rotor result, which can lead to accelerated wear of the rotor bearing.

Such a typical liquid ring machine achieves a reduction in power consumption, along with simultaneously improved running properties when liquids are conveyed together. This is achieved by providing a relief passage separate from the pressure slot of the control disk in the control body formed as a flat control disk. This relief passage is covered by the rotating liquid ring when liquids are conveyed together. The liquid ring machine disclosed in the German Patent Document does not provide any further explanation about the function of the relief passage.

SUMMARY OF THE INVENTION

The present invention relates to a liquid ring machine in which the total amount of liquid resulting from the usual working liquid and from the additional liquid occurring as a result of the process in question can be kept as constant as possible, so that an approximately uniform liquid ring thickness can be achieved.

According to an embodiment of the present invention, the relief passage is directly connected with the working liquid feed line of the liquid ring machine. Excess liquid exits through the relief passage and is directly fed to the working liquid. In the case where several liquids are conveyed together, the liquid ring thickness increases and thereby the amount of liquid exiting through the relief passage also increases. This liquid is conveyed directly to the working liquid.

This results in a reduction of the need for working liquid. Accordingly, since liquids are conveyed together automatically, an increase in the liquid ring thickness results in a throttling of the working liquid feed.

According to a further embodiment of the present invention, the relief passage is connected with a closed feed channel which opens outside the machine housing. In this embodiment, the increased amount of liquid which results when the liquid ring thickness increases is still conveyed away outside of the machine. An increased conveyance of several liquids results in increased pressure conditions in the pressure region, so that an increased exit of liquid through the relief passage of the liquid ring machine is effected. The pressure conditions which result therefore automatically regulate the liquid ring thickness.

A connection between the relief passage and the working liquid feed line, which runs outside of the housing, offers advantages with regard to accessibility and the cooling effect which can be achieved, while a connection located within the housing results in compact construction. In accordance with a further embodiment of the present invention, the connection can be provided either in the housing or outside of the housing. The connection can therefore be adapted to the operation and installation conditions in each instance.

Because the connection between the relief passage and the working liquid feed line is integrated in the lateral shield, there is no additional production effort for this connection. In addition, passages and bores in the pressure-impacted machine housing, which could result in a reduction in the strength of the machine housing, are eliminated. Another advantage of this connection is that the excess working liquid can flow off via a short connection path, without any additional expenditure of energy.

The liquid rotating in the liquid ring machine may be maintained constant in that a control element controls the feed of the working liquid as a function of the amount of liquid flowing through the relief passage.

Hydraulic valves, especially ball valves or plate valves, are suitable as control elements. Such valves are passive elements which control the working liquid feed solely on the basis of the pressure conditions which result, without any additional control elements.

Because the valves are accessible from the outside in their installed position, an adjustment of the valves in accordance with the working conditions can be made. Any maintenance work, such as due to dirt resulting from operation, is also facilitated by this.

According to another further embodiment of the present invention, only a valve to control the liquid ring thickness is required. The valve in question is installed in such a manner at the location at which the connection coming from the relief passage opens into the working liquid feed line that the valve influences the flow resistance of both liquid paths at the same time. The positioning of the valve has the result that the valve releases the connection leading to the relief passage to the same extent to which it simultaneously throttles the working liquid feed. The liquid flowing out through the relief passage then supplements the working liquid by precisely the proportion by which it was reduced. The liquid additionally conveyed in the liquid ring accordingly also results in a reduction in the working liquid demand. In an extreme case, the machine can actually be fed solely from the liquid which flows out through the relief passage. In this case, the valve is completely open and therefore at the same time, the working liquid feed is shut off to the greatest possible extent.

The connection between the relief passage and the working liquid feed line does not require any noteworthy additional production effort, since the connection is made via at least one line channel provided in the lateral shield, which was already taken into consideration when the lateral shield was cast.

The glands which serve to seal the shaft must be cooled, because of the friction stress. The liquid which flows out through the relief passage can also be provided to relieve the gland feed, if a corresponding connection is provided. In this way, the cooling of the glands can be entirely or additively taken over by the liquid flowing out of the relief passage.

BRIEF DESCRIPTION OF THE DRAWINGS

Exemplary embodiments of a liquid ring machine according to the present invention are explained in greater detail, on the basis of the following drawings.

DETAILED DESCRIPTION

Figure 1:
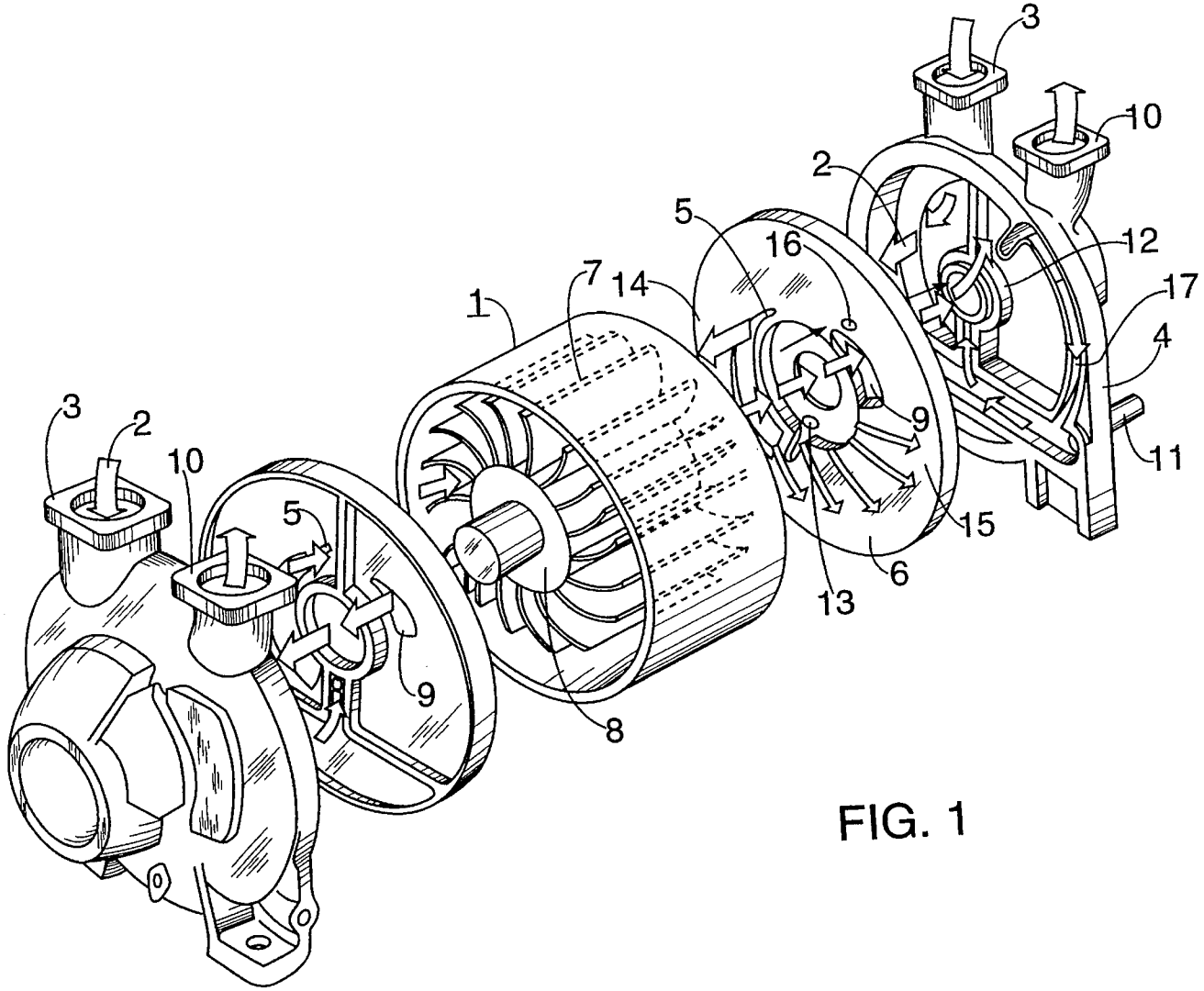
FIG. 1 illustrates a liquid ring machine in an exploded view.

In the liquid ring machine 1 shown in FIG. 1, the path of a transport medium from a suction fitting 3 of the liquid ring machine 1 via its lateral shield 4 and the suction slot 5 of a control body, structured as a flat control disk 6 here, into a rotor cell space defined by one of two blades 7 of the rotor 8, in each instance, and a co-rotating liquid ring, is marked with heavy arrows 2. Because of the eccentric position of the rotor 8, the rotor cell space constantly changes its size during a rotation of the rotor 8. Because of the reduction in the rotor cell space which takes place in the pressure-side control disk region 15, the transport medium is compressed and pushed out via a pressure slot 9 located in the control disk 6. The transport medium compressed in this way then flows out through a pressure fitting 10. Due to the method of operation, part of the working liquid which is needed to build up the liquid ring is also ejected. For this reason, working liquid constantly has to be supplied via a working liquid feed line 11. The working liquid reaches the suction-side control disk region 14 of the liquid ring machine 1 via a channel system in the hub region 12 and corresponding passages 13 in the control disk 6.

In the case where several liquids are conveyed, the excess working liquid 20 is pushed out through a relief passage 16 located in the pressure-side control disk region 15, and fed to the working liquid feed line 11, which is also located in the lateral shield 4, via a connecting line 17 which is integrated in the lateral shield. This prevents an increase in the liquid ring thickness and therefore an over-compression of the transport medium. Further disadvantages, such as an increased power requirement and a deterioration of quiet running, are also eliminated in this way.

Figure 2:
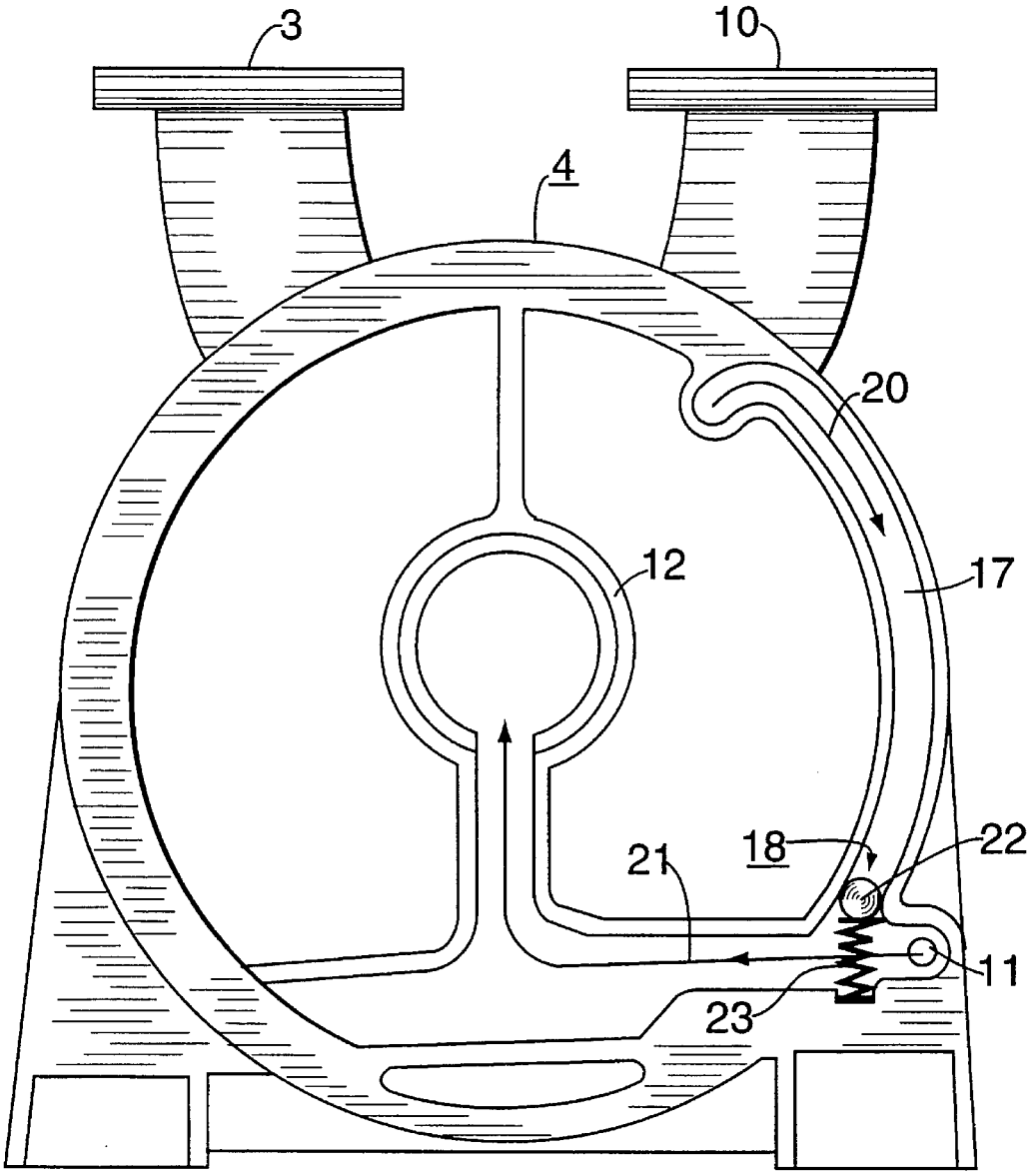
FIG. 2 illustrates a top view of a lateral shield of a liquid ring machine with a control element structured as a ball valve in the closed position.
Figure 3:
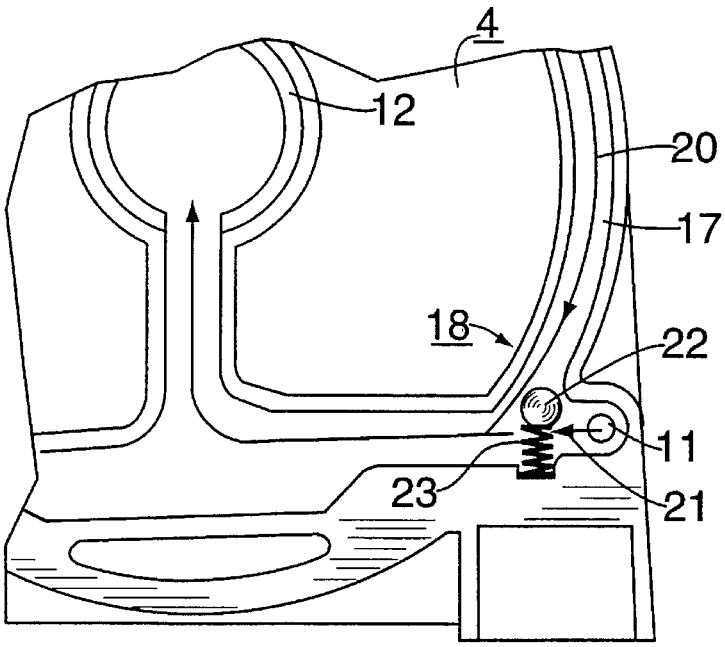
FIG. 3 illustrates a top view of a partial view of the lateral shield of a liquid ring machine with a control element structured as a ball valve in a partially open position.
Figure 4:
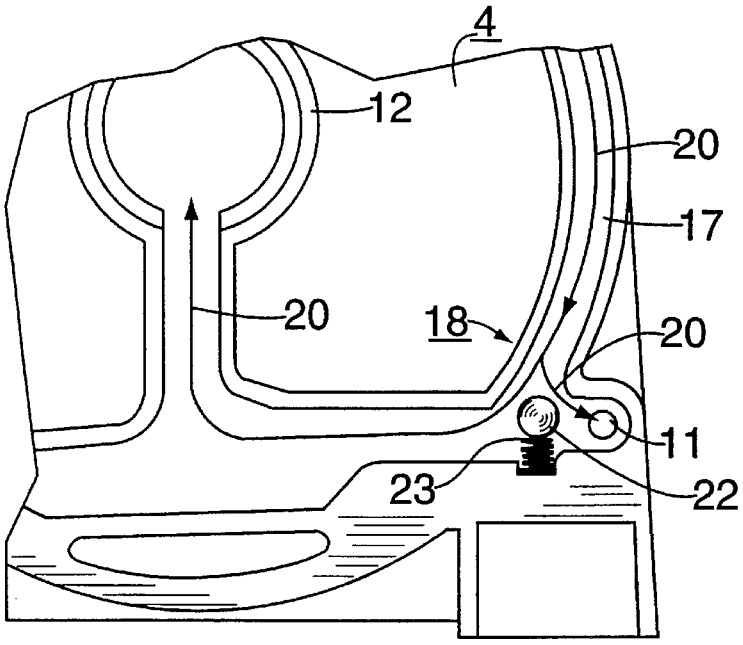
FIG. 4 illustrates a top view of a partial view of the lateral shield of a liquid ring machine with a control element structured as a ball valve in the fully open position.

FIG. 2 to FIG. 4 illustrate a way in which the control of the working liquid feed takes place as a function of the excess liquid 20 flowing out through the relief passage 16. At the point where the connection leading from the relief passage 16 to the working liquid feed line 11 opens into the working liquid feed line 11, a ball valve 18 is installed in such a way that it influences both liquid paths.

In FIG. 2, the ball valve 18 is closed. The ball 22 of the ball valve 18 closes off the connecting line 17 leading away from the relief passage 16, under the influence of a spring 23. The ball 22 is pressed into the opening by the spring 23, which rests against the wall opposite the opening of the connecting line 17. This does not allow any liquid to reach the working liquid feed line 11 via the connecting line 17. Any excess liquid 20 which flows out is held back in the connecting line 17 in this valve position. Entry of working liquid from outside the machine 1, for example from a supply container not shown in the drawing, is not prevented by the ball valve 18.

In the operating state of the liquid ring machine 1 shown in FIG. 3, several liquids are conveyed together on the suction side. Excess liquid flows through the relief passage 16 into the connecting line 17 to a greater extent. The ball valve 18 is partially opened, because of the hydraulic pressure on it. This causes the liquid path for the excess liquid 20 present in the connecting line 17 to be partially released. At the same time, the entry of working liquid from outside the machine 1 is prevented by means of the partially opened ball valve 18 and the reduction in the cross-section of the resulting working liquid feed line 11.

This results in a reduction of the self-primed working liquid 21. The excess liquid which flows out of the relief passage 16 replaces this working liquid 21 which is saved.

FIG. 4 illustrates the case of a strong conveyance of several liquids together on the suction side. In this case, the ball valve 18 is completely open. The excess liquid 20 which flows out through the relief passage 16 flows into the working liquid feed line 11 and/or into the working liquid supply container outside of the liquid ring machine 1, practically without hindrance. No working liquid 21 is drawn in any more. In this case, the working water feed accordingly takes place solely from the liquid which is conveyed in addition and occurs on the suction side.

Figure 5:
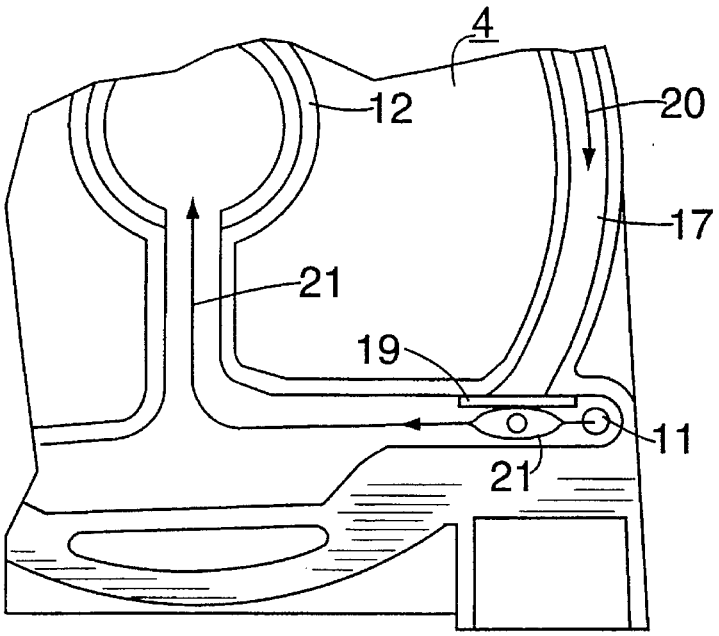
FIG. 5 illustrates a top view of a partial view of the lateral shield of a liquid ring machine with a control element structured as a plate valve in the closed position.
Figure 6:
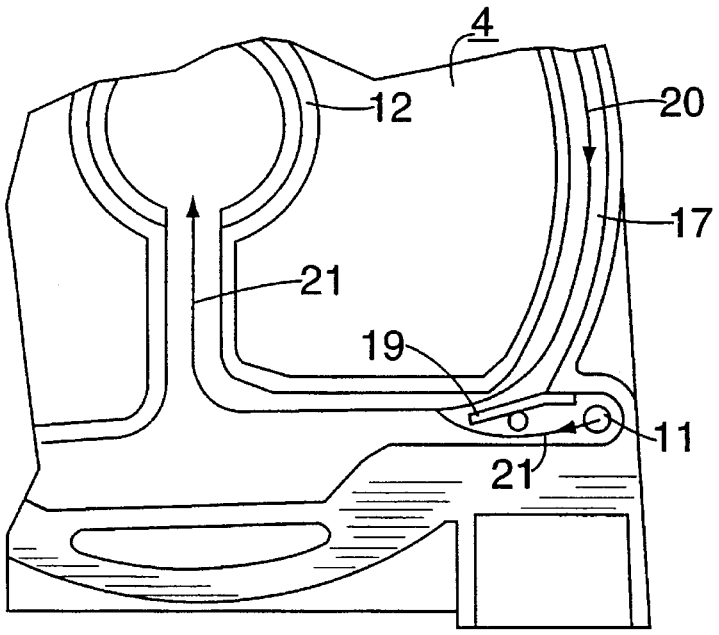
FIG. 6 illustrates a top view of a partial view of the lateral shield of a liquid ring machine with a control element structured as a plate valve in a partially open position.
Figure 7:
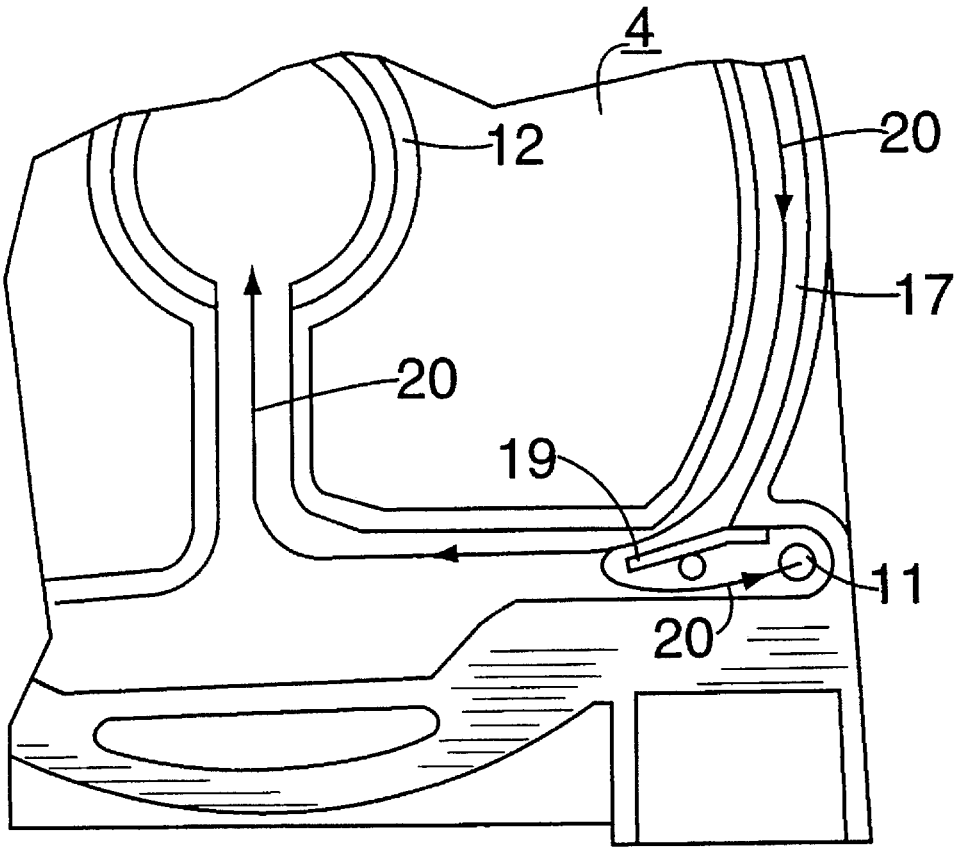
FIG. 7 illustrates a top view of a partial view of the lateral shield of a liquid ring machine with a control element structured as a plate valve in the fully open position.

A control analogous to the control with the ball valve 18, with a plate valve 19, is shown in FIG. 5–FIG. 7. FIG. 5 shows a closed plate valve 19 for the operating case without any additional liquid conveyed on the suction side. The connecting line 17 is closed, while the feed of working liquid is unhindered. In FIG. 6, the plate valve is partially opened. Here again, the proportion of the self-primed working liquid 21 is reduced in favor of the excess liquid 20 flowing out of the relief passage 16, because of the reduction in cross-section which occurs in the working liquid feed line 11. The amount of working liquid supplied in the hub region 12 therefore does not change, so that in spite of the fact that several liquids are conveyed, the liquid ring thickness remains almost constant. In the representation according to FIG. 7, which applies for the case of strong conveyance of several liquids on the suction side, the plate valve 19 is fully opened. The excess liquid 20 which flows out of the connecting line 17 serves exclusively to supply working liquid to the liquid ring machine 1. Any amount of liquid which goes beyond the need for working liquid can be conveyed off into a supply container located outside of the liquid ring machine 1.

Figure 8:
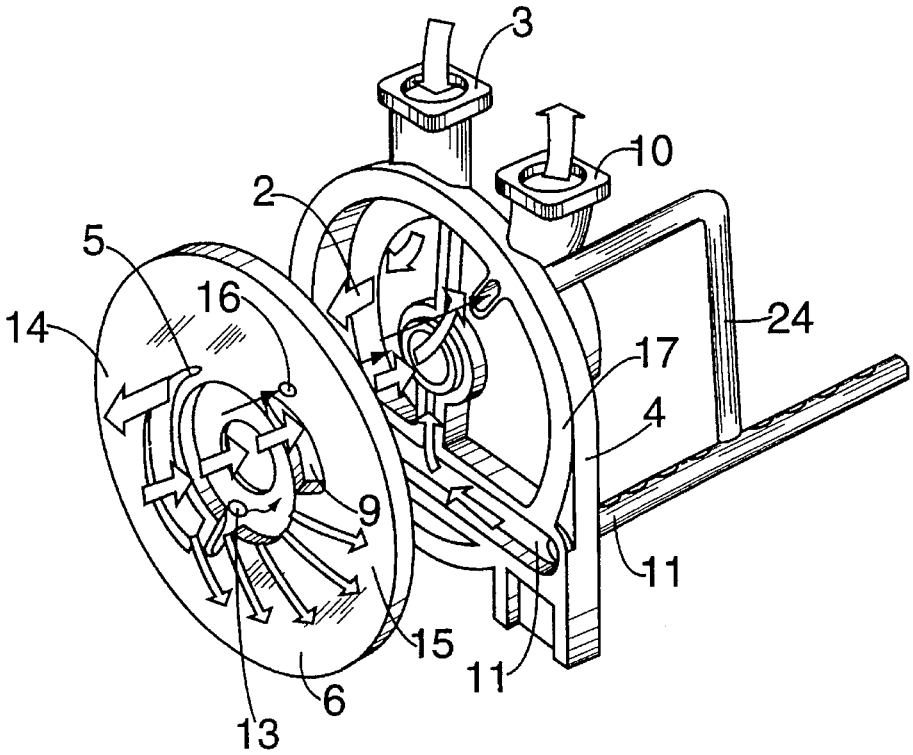
FIG. 8 illustrates an exploded view of a portion of a liquid ring machine in which the connection between the relief passage and the feed line is provided outside of the housing.

FIG. 8 shows the connection of the relief passage 16 to a feed line 11 for working liquid by means of a connecting line 24 arranged outside of a lateral shield 4. Accordingly, any excess liquid flowing out via the relief passage 16 is again fed by way of the connecting line 24 and the feed line 11 to the working liquid.

Figure 9:
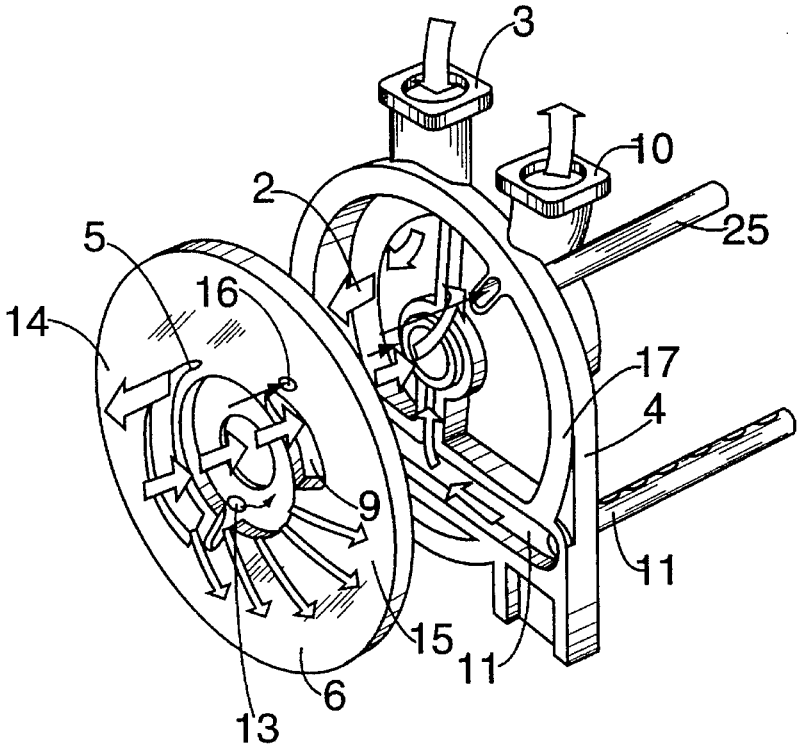
FIG. 9 illustrates an exploded view of a portion of a liquid ring machine in which the relief passage is connected to a drain pipe.

FIG. 9 shows an exemplary embodiment in which the relief passage 16 is connected to a drain pipe 25 that is attached to the lateral shield 4 so that the excess liquid flowing out via the relief passage 16 flows outside the housing and is not again fed to the working liquid.

I claim:

1. A liquid ring machine, comprising:

a rotor including a rotor shaft;

a machine housing surrounding said rotor, said machine housing including at end faces thereof two lateral shields supporting said rotor shaft such that said rotor is eccentrically positioned in said machine housing;

a control body in said machine housing for the rotor, said control body having a suction slot in a suction region of the control body and a pressure slot in a pressure region of the control body, said control body also including a relief passage in the pressure region; and a feed line, located in the housing, for feeding working fluid to the machine, the feed line being connected to said relief passage so that excess liquid exiting through the relief passage is fed to the working liquid.

2. The liquid ring machine according to claim 1, wherein the connection between the relief passage and the working liquid feed line is integrated into a lateral shield.

3. A liquid ring machine, comprising:

a rotor including a rotor shaft;

a machine housing surrounding said rotor, said machine housing including at end faces thereof two lateral shields supporting said rotor shaft such that said rotor is eccentrically positioned in said machine housing;

a control body in said machine housing for the rotor, said control body having a suction slot in a suction region of the control body and a pressure slot in a pressure region of the control body, said control body also including a relief passage in the pressure region;

a feed line for feeding working fluid to the machine, the feed line being connected to said relief passage so that excess liquid exiting through the relief passage is fed to the working liquid; and a hydraulic valve for controlling the amount of working liquid supplied to the liquid ring machine as a function of the amount of liquid which flows off through the relief passage.

4. A liquid ring machine, comprising;

a rotor including a rotor shaft;

a machine housing surrounding said rotor, said machine housing including at end faces thereof two lateral shields supporting said rotor shaft such that said rotor is eccentrically positioned in said machine housing;

a control body in said machine housing for the rotor, said control body having a suction slot in a suction region of the control body and a pressure slot in a pressure region of the control body, said control body also including a relief passage in the pressure region; and a feed line for feeding working fluid to the machine, the feed line being connected to said relief passage so that excess liquid exiting through the relief passage is fed to the working liquid;

wherein a control element is installed at a location at which the connection coming from the relief passage opens into the working liquid feed line so that the control element influences the flow resistance of both liquid paths at the same time.

5. A liquid ring machine, comprising:

a rotor including a rotor shaft;

a machine housing surrounding said rotor, said machine housing including at end faces thereof two lateral shields supporting said rotor shaft such that said rotor is eccentrically positioned in said machine housing;

a control body in said machine housing for the rotor, said control body having a suction slot in a suction region of the control body and a pressure slot in a pressure region of the control body, said control body also including a relief passage in the pressure region; and a feed line for feeding working fluid to the machine, the feed line being connected to said relief passage so that excess liquid exiting through the relief passage is fed to the working liquid, and wherein the connection between the relief passage and the working liquid line takes place via at least one line channel provided in a lateral shield.

6. A liquid ring machine, comprising:

a rotor including a rotor shaft;

a machine housing surrounding said rotor, said machine housing including at end faces thereof two lateral shields supporting said rotor shaft such that said rotor is eccentrically positioned in said machine housing;

a control body in said machine housing for the rotor, said control body having a suction slot in a suction region of the control body and a pressure slot in a pressure region of the control body, said control body also including a relief passage in the pressure region;

a feed line for feeding working fluid to the machine, the feed line being connected to said relief passage so that excess liquid exiting through the relief passage is fed to the working liquid; and a ball valve for controlling the amount of working liquid supplied to the liquid ring machine as a function of the amount of liquid which flows off through the relief passage.

7. A liquid ring machine, comprising:

a rotor including a rotor shaft;

a machine housing surrounding said rotor, said machine housing including at end faces thereof two lateral shields supporting said rotor shaft such that said rotor is eccentrically positioned in said machine housing;

a control body in said machine housing for the rotor, said control body having a suction slot in a suction region of the control body and a pressure slot in a pressure region of the control body, said control body also including a relief passage in the pressure region;

a feed line for feeding working fluid to the machine, the feed line being connected to said relief passage so that excess liquid exiting through the relief passage is fed to the working liquid; and a plate valve for controlling the amount of working liquid supplied to the liquid ring machine as a function of the amount of liquid which flows off through the relief passage.

* * * * *